US006340954B1

(12) United States Patent
Annamaa et al.

(10) Patent No.: US 6,340,954 B1
(45) Date of Patent: Jan. 22, 2002

(54) DUAL-FREQUENCY HELIX ANTENNA

(75) Inventors: Petteri Annamaa; Tero Kuittinen; Mika Bordi; Pertti Puurunen, all of Oulu (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 09/355,022

(22) PCT Filed: Dec. 15, 1998

(86) PCT No.: PCT/FI98/00982

§ 371 Date: Jul. 26, 1999

§ 102(e) Date: Jul. 26, 1999

(87) PCT Pub. No.: WO99/31756

PCT Pub. Date: Jun. 24, 1999

(30) Foreign Application Priority Data

Dec. 16, 1997 (FI) ..... 974527

(51) Int. Cl.[7] ..... H01Q 1/36
(52) U.S. Cl. ..... 343/895; 343/702
(58) Field of Search ..... 343/895, 866, 343/867, 870, 725, 728, 702

(56) References Cited

U.S. PATENT DOCUMENTS

| | | | | | |
|---|---|---|---|---|---|
| 3,852,759 | A | * | 12/1974 | Felsenheld et al. | 343/725 |
| 4,161,737 | A | * | 7/1979 | Albright | 343/895 |
| 4,169,267 | A | | 9/1979 | Wong et al. | 343/895 |
| 4,442,438 | A | * | 4/1984 | Siwiak et al. | 343/895 |
| 4,742,359 | A | | 5/1988 | Ishino et al. | 343/895 |
| 5,329,287 | A | | 7/1994 | Strickland | 343/725 |
| 5,406,693 | A | * | 4/1995 | Egashira et al. | 343/895 |
| 5,436,633 | A | | 7/1995 | Liu | 343/723 |
| 5,489,916 | A | * | 2/1996 | Waterman et al. | 343/895 |
| 6,054,966 | A | * | 4/2000 | Haapala | 343/895 |
| 6,112,102 | A | | 8/2000 | Zhinong | |

FOREIGN PATENT DOCUMENTS

| | | | |
|---|---|---|---|
| FI | 943339 | 1/1995 | H01Q/1/36 |
| FI | 944798 | 4/1995 | H01Q/1/36 |
| FI | 98165 | 12/1996 | H01Q/1/24 |
| FI | 97027 | 7/1998 | H01Q/1/24 |
| WO | WO 98/15028 | 4/1998 | H01Q/1/36 |
| WO | WO 98/15029 | 4/1998 | H01Q/1/36 |

* cited by examiner

*Primary Examiner*—Don Wong
*Assistant Examiner*—Thuy Vinh Tran
(74) *Attorney, Agent, or Firm*—Darby & Darby

(57) ABSTRACT

An antenna (400; 600) for transmitting and receiving radio-frequency signals comprises a cylindrical coil conductor (601) having a turn A and a turn B and between them other turns. The pitch (x1) of turn A is unequal to the pitch (x2) of said turn B, and the pitches of the other turns between turns A and B are in the order of magnitude between the pitches of turns A and B.

6 Claims, 4 Drawing Sheets

DUAL-FREQUENCY HELIX ANTENNA

FIELD OF INVENTION

The invention relates in general to antenna structures in radio apparatus. In particular the invention relates to an antenna structure which has two resonating frequencies different from each other. This patent application uses a mobile phone as an example of a radio apparatus.

DESCRIPTION OF RELATED ART

In different parts of the world there are cellular radio systems in use that differ from each other significantly in their operating frequency ranges. As regards digital cellular radio systems, the operating frequencies of the Global System for Mobile Telecommunications (GSM) are in the 890–960 MHz range, the operating frequencies of the Japanese Digital Cellular (JDC) system are in the 800 MHz and 1500 MHz bands, the operating frequencies of the Personal Communication Network (PCN) are in the 1710–1880 MHz range, and those of the Personal Communication System (PCS) in the 1850–1990 MHz range. The operating frequencies of the American AMPS mobile phone system are between 824 MHz and 894 MHz and those of the Digital European Cordless Telephone (DECT) system in the 1880–1900 MHz range.

Since the resonating frequency of a prior-art radio-frequency antenna depends in a known manner on the length of the antenna, through the wavelength, a particular antenna can be used only in a mobile phone designed for a single-frequency cellular radio system. In some cases, however, it is desirable that one and the same phone could be used in some other frequency range, too. In addition to other suitable RF parts, a working antenna arrangement is then needed.

U.S. Pat. No. 4,442,438 discloses an antenna structure resonating at two frequencies, comprising, as shown in FIG. 1, two helices 101, 102 and one whip element 103. The helices 101 and 102 are positioned one after the other and their adjacent ends 104 and 105 constitute the feed point of the combined structure. The whip element 103 is partly inside the upper helix 101 and its feed point 106 is at its lower end. An RF signal is brought to the feed point 106 via a coaxial conductor 107 coinciding with the symmetry axis of the structure and traveling through the lower helix 102. The feed point 106 of the whip element is coupled to the lower end 104 of the upper helix, and the lower helix is coupled at its upper end 105 to the conductive and grounded shroud of the coaxial conductor 107. The structure's first resonating frequency is the resonating frequency of the combined structure of helices 101 and 102; 827 MHz in the illustrative embodiment. The second resonating frequency of the structure is the common resonating frequency of the upper helix 101 and the whip element 103; 850 MHz in the illustrative embodiment. Thus, helix 101 and whip element 103 are such that they have substantially the same resonating frequency.

The structure disclosed by the US patent is relatively complex. From the manufacturing standpoint, the most difficult part in the structure is the feed point arrangement at the middle of the antenna, where the lower end 106 of the whip element and the lower end 104 of the upper helix have to be galvanically coupled, and the lower helix has to be coupled at its upper end 105 to the shroud of the coaxial conductor feeding the whip element. According to the material presented in the patent the difference between the two resonating frequencies achieved by the structure is small because the dimensions of the upper helix 101 and the whip element 103 have to be such that they have substantially the same common resonating frequency, so the structure cannot be applied to a phone operating at the GSM and PCN frequencies, for example. Indeed, in the description of the patent it is stated that an object of the invention is to broaden the resonating frequency area of the mobile phone antenna such that it would better cover the whole frequency range in one cellular radio system.

FI patent application 963275 (LK-Products) discloses a dual-frequency antenna structure according to FIG. 2 in which there is at a certain point between the ends of a helix antenna 201 wound into a cylindrical coil a coupling part 202 for coupling to a second antenna element 203. The cylindrical coil conductor 201, which is the first antenna element in the antenna, comprises in the direction of its longitudinal axis a lower part 204 and an upper part 205, and the second antenna element 203 is connected to the cylindrical coil conductor through a fixed coupling at the coupling point 202 between the lower and upper parts. The two radiating antenna elements of the structure have a common lower part up to the branching point consisting of the coupling part, from which point on the electrical lengths of the antenna elements are different. The first resonating frequency of the combined antenna structure is determined by the total electrical length of the common lower part of the antenna elements and the upper part of the first antenna element. The second resonating frequency is determined by the total electrical length of the common lower part of the antenna elements and the upper part of the second antenna element. In addition, the resonating frequencies are affected by the mutual coupling of the antenna elements and the fact that the antenna elements are electrically conductive bodies in the near fields of one another so that they put a load on each other. The antenna structure according to FIG. 2 is relatively difficult to precisely dimension to the desired frequencies since the coupling point between the antenna elements requires quite accurate positioning. In addition, the electrical coupling in the coupling point easily becomes unreliable.

FI patent application 970297 (LK-Products) discloses an antenna according to the principle illustrated in FIG. 3 wherein an antenna element 301 has a first end and a second end and a tapping point 302 which is located at a certain point between the ends of the antenna element. The tapping point divides the antenna element asymmetrically such that the electrical length from the tapping point to the upper end is considerably greater than the electrical length from the tapping point to the lower end. The feed conductor 303 of the antenna, which connects the antenna element electrically to a radio apparatus, is coupled to the antenna element at the tapping point. A substantial portion of the feed conductor also serves as a radiating element because the feed conductor is electrically unshielded, i.e. it has no shroud made of a conductive material around it. The total electrical length of the antenna structure at a first operating frequency is the sum of the electrical lengths of the feed conductor 303 and the portion extending from the tapping point 302 to a first end of the antenna element 301. Correspondingly, the total electrical length of the antenna structure at a second operating frequency is the sum of the electrical lengths of the feed conductor 303 and the portion extending from the tapping point 302 to a second end of the antenna element 301. The antenna element 301 may be a helix, a straight conductor or a combination of those. The disadvantage of this antenna structure is the difficulty in manufacturing the antenna structure such that the tapping point 302 will be sturdy.

SUMMARY OF THE INVENTION

An object of the present invention is to provide an antenna structure which can be applied in two operating frequency ranges and which is simple to manufacture and reliable in its operation. Another object of the invention is to provide an antenna structure which can be easily dimensioned to two different operating frequencies. A further object of the invention is that the antenna structure according to the invention is applicable to large-scale series production.

The objects of the invention are achieved by using as an antenna element a helix the pitch of which decreases when moving away from the feed point.

The antenna according to the invention comprises a cylindrical coil conductor having a turn A and turn B and other turns between them. The antenna is characterized in that the pitch of turn A does not equal the pitch of turn B and the pitches of the other turns between turn A and turn B are arranged according to the magnitude between the pitch of turn A and the pitch of turn B.

It is known that a conductive body may have multiple resonating frequencies the lowest one of which is the so-called fundamental frequency, the rest being harmonic frequencies. The invention is based on the observation that the resonating frequency of a cylindrical coil conductor, or helix, is changed when the dimensional parameters of the helix are changed in the various parts of the structure. The electrical length of the helix conductor determines the fundamental frequency. In connection with helices, the distance between the ends of a turn in the direction of the longitudinal axis of the helix is called a pitch. When the feed point is at one end of a helix and the pitch either decreases or increases towards the other end, the mutual interaction of the turns changes the resonating frequencies. When the number of turns, pitch of the helix at various points and other parameters are suitably selected, the resonating frequencies will be at such positions on the frequency axis that the structure can be used in two cellular radio system frequency ranges.

BRIEF DESCRIPTION OF THE DRAWINGS

The invention will now be described in more detail with reference to the preferred embodiments presented by way of example and to the accompanying drawing wherein.

Figure 1:
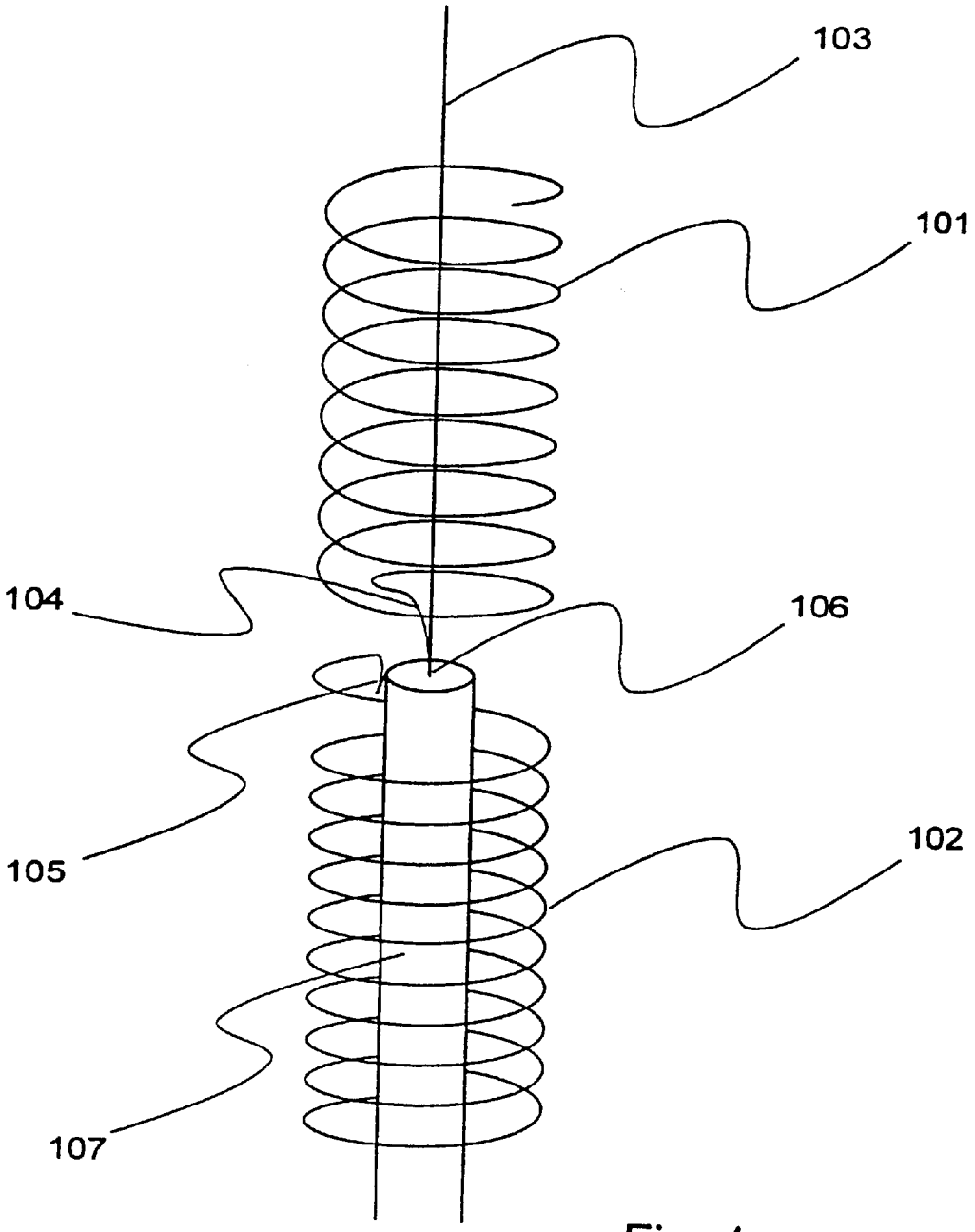
Fig. 1 PRIOR ART
FIG. 1 shows a known antenna structure.
Figure 2:
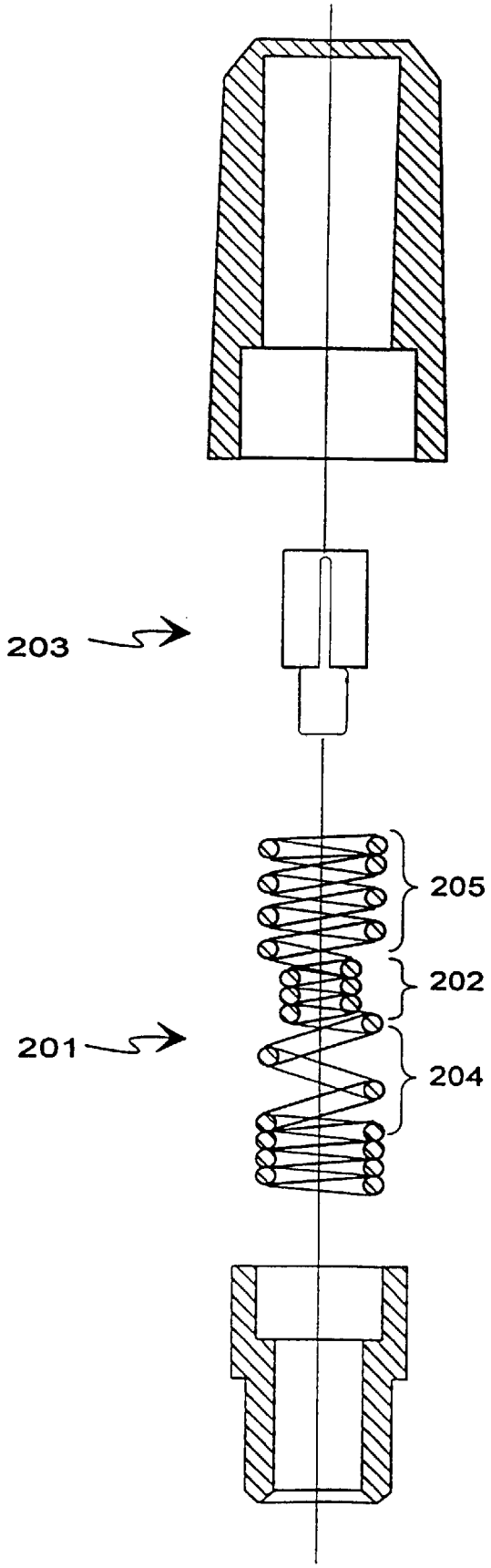
Fig. 2 PRIOR ART
FIG. 2 shows a second known antenna structure.
Figure 3:
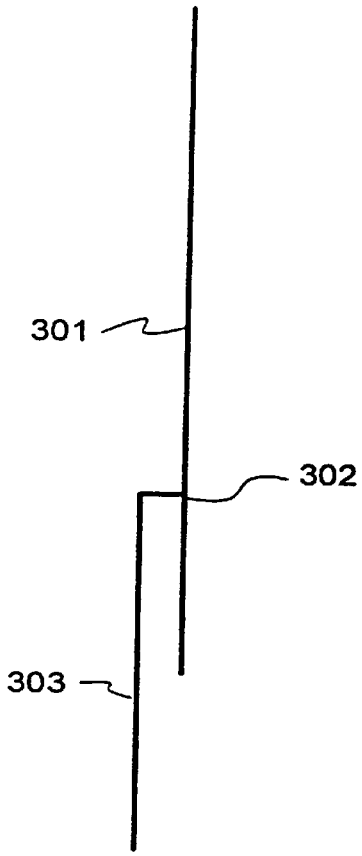
Fig. 3 PRIOR ART
FIG. 3 shows a third known antenna structure.

Above in conjunction with the description of the prior art reference was made to FIGS. 1 to 3, so below in the description of the invention and its preferred embodiments reference will be made mainly to FIGS. 4 to 6.

DETAILED DESCRIPTION OF THE INVENTION

Figure 4:
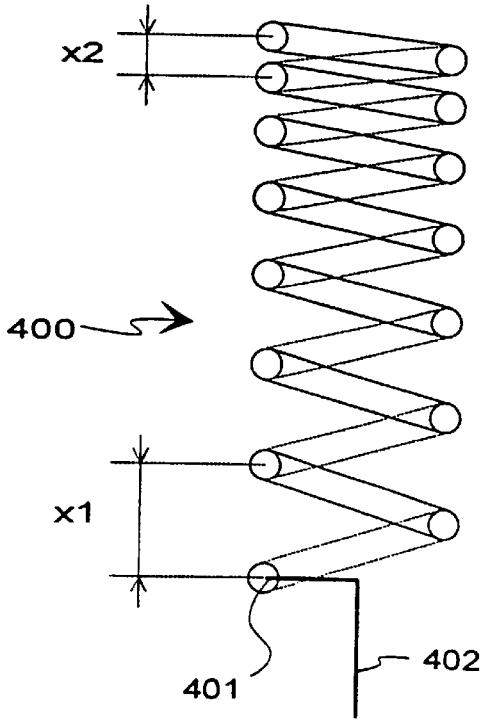
FIG. 4 shows the principle of the invention.

FIG. 4 shows a longitudinal section of a helix antenna 400 having seven turns. Viewing from the feed point 401 the pitch x1 of the first turn is greater than the pitch x2 of the last turn. The pitches of the other turns decrease evenly from the first turn toward the last turn. In FIG. 4 the helix antenna is shown in the upright position but the invention does not limit the use or manufacture of the helix antenna according to the invention in any particular position. A feed point 401 and the leg 402 of the helix can be realised in such a manner that the helix conductor is bent into the shape of the black line shown in the Figure. In an alternative implementation the helix is connected at its bottom end, with respect to the position shown, to a coupling part having a cylindrical hollow into which the lowest turns of the helix are inserted. To that end, the bottom end of the helix may have a support thread (not shown) more densely wound than the rest of the helix, said support thread, when connected to the coupling part, will not serve as radiating element as the electrically conductive coupling part short circuits the turns of the support thread. Other known methods for creating a feed point 401 and for connecting the helix antenna to a radio apparatus can be used, too.

Figure 5:
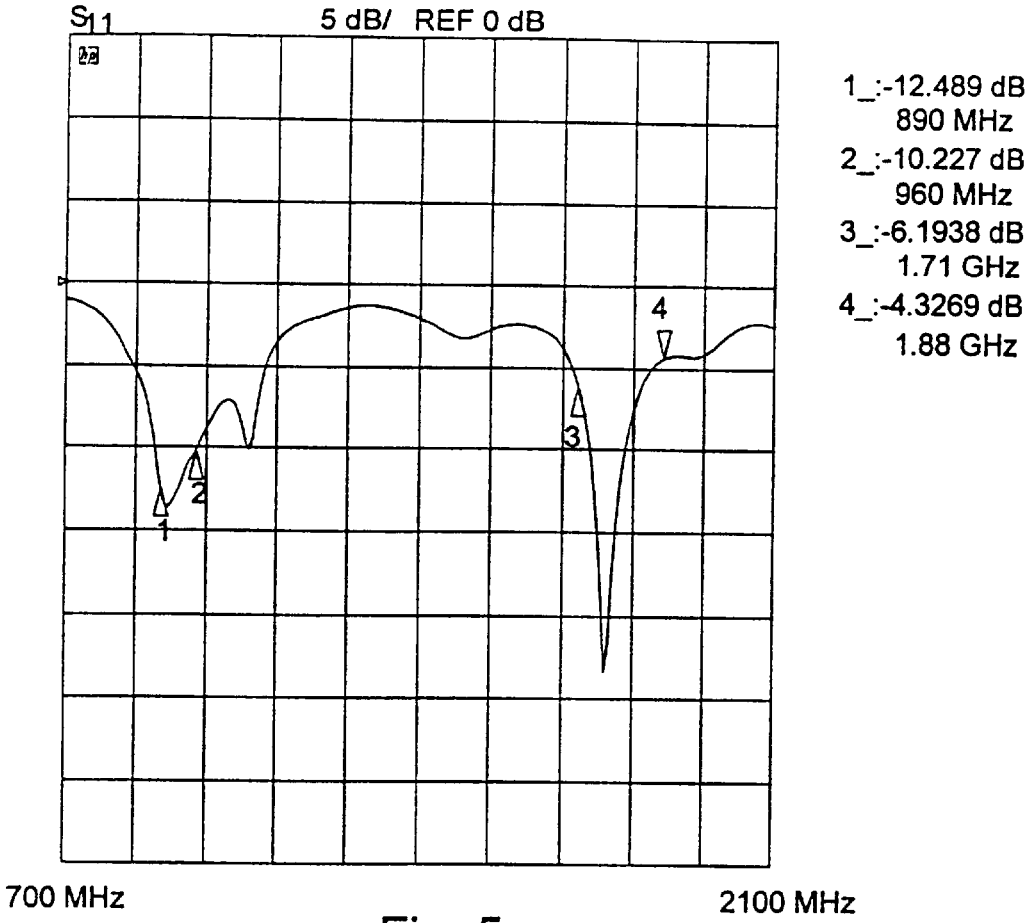
FIG. 5 shows measured properties of the structure according to FIG. 4.

FIG. 5 illustrates a measurement of the so-called s11 coefficient, or reflection coefficient, with the horizontal axis representing the frequency range of 700 MHz to 2100 MHz and the vertical axis representing the value of the reflection coefficient in units of decibel. The measurement concerns an antenna according to FIG. 4. The triangular symbol on the vertical axis represents 0 dB, one step on the vertical axis equals 5 dB and one step on the horizontal axis equals 140 MHz. The reflection coefficient tells how much of the radio-frequency power fed to the antenna via the feed point is reflected back. A low value of the reflection coefficient at a certain frequency means the antenna is suitable for that frequency. FIG. 5 shows that the antenna has two resonating frequency ranges wherein the value of the reflection coefficient is clearly smaller than −10 dB. The first resonating frequency range (s11<−10 dB) is about 880 MHz to 960 MHz, and the second resonating frequency range (s11<−10 dB) is about 1730 MHz to 1800 MHz.

Instead of becoming denser the turns of the helix may also become thinner, i.e. the pitch may increase from the feed point on. The resonating frequency ranges of the antenna according to the invention depend among other things on the thickness of the helix conductor, pitch of the turns and on the diameter of the helix. The table below shows some measurement results for helices H1, H2, H3, H5, H6, H7, H8, H9, and H10 in which the height of the helix from the beginning of the first turn to the end of the last turn is 22 mm, the length of the leg (402 in FIG. 4) of the helix is 10 mm, and the thickness of the helix conductor is 0.9 mm, as well as for a helix H11 in which the height of the helix is 16 mm, thickness of the helix conductor is 0.9 mm, height of the leg is 6 mm and the diameter of the leg is 3 nun, as well as for a helix H12 in which the height of the helix is 16 mm, thickness of the helix conductor is 0.8 mm, height of the leg is 6 mm and the diameter of the leg is 3 mm. The lower and upper diameter values shown in the table are inner diameters and the frequencies f1 and f3 are the resonating frequencies in the frequency ranges for which the helix is suitable.

| | H1 | | H2 | | H3 | | H5 (decr. pitch) | |
|---|---|---|---|---|---|---|---|---|
| Lower diameter/mm | 7.1 × 7.1 | | 2 × 2 | | 3 × 3 | | 7.1 | |
| Upper diameter/mm | 7.1 × 7.1 | | 8.2 × 8.2 | | 14 × 14 | | 7.1 | |
| Pitch/mm | 4 | | 2.5 | | 5 | | 5 + 4.5 + 4 + 3.5 + 2.3 + 2 | |
| Outer volume/mm$^3$ | 1110 | | 620 | | 1530 | | 1110 | |
| Freq./Real part of imp. | f/MHz | Re/Ω | f/MHz | Re/Ω | f/MHz | Re/Ω | f/MHz | Re/Ω |
| Resonance f1 | 935.1 | 43 | 902.9 | 54 | 893.9 | 56 | 898.5 | 55 |
| Resonance f3 | 2213 | 12 | 2011 | 21 | 2046 | 19 | 1812 | 23 |
| Ratio f3/f1 | 2.37 | 0.28 | 2.23 | 0.39 | 2.29 | 0.34 | 2.02 | 0.42 |

| | H6 (decr./pitch) | | H7 (incr./pitch) | | H8 (incr./pitch) | | H9 | |
|---|---|---|---|---|---|---|---|---|
| Lower diameter/mm | 7.1 | | 7.1 | | 7.1 | | 7.1 × 7.1 | |
| Upper diameter/mm | 7.1 | | 7.1 | | 7.1 | | 2 × 2 | |
| Pitch/mm | 6.5 + 5 + 3.5 + 2.7 + 2 + 1.8 | | 3 + 3.5 + 4 + 4.4 + 4.6 | | 2 + 3 + 4 + 5 + 6 + 7 | | 2.3 | |
| Outer volume/mm$^3$ | 1110 | | 1110 | | 1110 | | 510 | |
| Freq./Real part of imp. | f/MHz | Re/Ω | f/MHz | Re/Ω | f/MHz | Re/Ω | f/MHz | Re/Ω |
| Resonance f1 | 906.0 | 55 | 905.9 | 47 | 889.6 | 48 | 911.4 | 43 |
| Resonance f3 | 1771 | 28 | 2255 | 12 | 2379 | 10 | 2371 | 10 |
| Ratio f3/f1 | 1.95 | 0.51 | 2.49 | 0.26 | 2.67 | 0.21 | 2.60 | 0.23 |

| | H10 | | H11* | | H12** | |
|---|---|---|---|---|---|---|
| Lower diameter/mm | 7/1 × 7/1 | | 5/1 × 5/1 | | 6.2 × 6.2 | |
| Upper diameter/mm | 5 × 5 | | 5.1 × 5.1 | | 5.4 × 5.4 | |
| Pitch/mm | 3.1 | | 1.7 | | 3.5 + 3.0 + 2.4 + 2+ 1.5 + 1.2 + 1, 1 + 1 | |
| Outer volume/mm$^3$ | 830 | | 450 | | 550 | |
| Freq./Real part of imp. | f/MHz | Re/Ω | f/MHz | Re/Ω | f/MHz | Re/Ω |
| Resonance f1 | 902.9 | 48 | 911.1 | 20 | 901 | 21 |
| Resonance f3 | 2203 | 10 | 2081 | 12 | 1801 | 11 |
| Ratio f3/f1 | 2.43 | 0.21 | 2.28 | 0.6 | 2.0 | 0.52 |

* and **: dimensions different from the other helices, see above

In the table, the pitch of the helices H1, H2, H3, H9, H10 and H11 is the same in all turns, i.e. they are not in accordance with the invention. In helices H2, H3, H9, H10 and H12 the diameters of the turns change between the feed point and the second end of the helix: the lower diameter refers to the diameter nearest to the feed point. The values of the ratio f3/f1 printed in boldface emphasize helices H5, H6 and H12 which from the resonating frequency standpoint are especially suitable as antennas for a GSM/PCN dual-mode phone.

Figure 6:
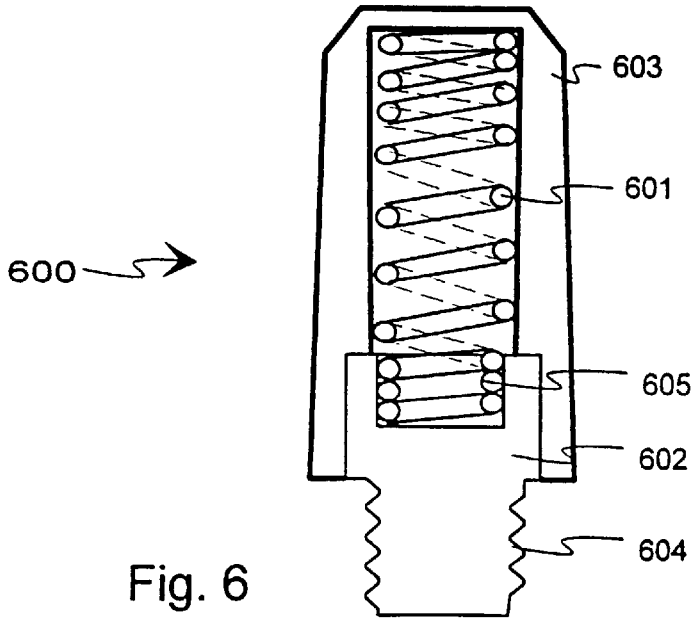
FIG. 6 shows the antenna according to the invention with a protective housing.

FIG. 6 shows in the form of a longitudinal section an antenna 600 according to the invention comprising a helix conductor 601, coupling part 602 made of metal or another electrically conductive material, and a protective housing 603. The outer surface of the coupling part 602 has threads 604 whereby the antenna 600 can be mechanically and electrically coupled to a radio apparatus (not shown). The lower part of the helix conductor has a dense support thread 605 whereby the helix conductor 601 is attached to a cylindrical hollow in the coupling part 602. The support thread does not belong to the radiating portion of the antenna. The protective housing 603 is made of a dielectric material, preferably injection-molded plastic, and it can be attached to the coupling part with glue or by means of fusion welding. The protective housing 603 may include components (not shown) supporting the helix conductor 601, such as a cylindrical pin pushed inside the helix from the top.

The present invention is not limited to the exemplary embodiments described here, nor to any particular application but can be used in antennas in different applications and at different frequencies, advantageously radio frequencies such as UHF and VHF. The structure is advantageously used in antennas of mobile phones. The structure may be modified within the scope of the invention defined by the claims set forth below. The pitches of the first and last turns of the helix may even be almost identical if there is a second turn between them having a pitch unequal to that of the first turn, if then there are other turns between the first and said second turn where the pitch changes in a regular manner.

What is claimed is:

1. An antenna for transmitting and receiving radio-frequency signals, comprising:

a cylindrical coil conductor having a first and second turn and one or more additional turns between said first and second turn; said first and second turn each having a pitch unequal to the pitch of the other of said first and second turn; and said one or more additional turns each having a pitch unequal to the pitch of the other of said additional turns; and said respective pitches of said one or more additional turns having values between the respective values of the pitches of said first and second turns;

wherein said turns and pitches are arranged such that the fundamental resonant frequency of the antenna is in the operational frequency range of a first cellular radio system and a harmonic resonant frequency of the antenna is in the operational frequency range of a second cellular radio system.

2. The antenna of claim 1, wherein said antenna includes a first and second end;

said first end located at said first turn and said second end located at said second turn;

said first end comprising a feed point of said antenna.

3. The antenna of claim 2, wherein the value of said pitch of said second turn is less than the value of the pitch of said first turn, whereby the value of the pitch of succeeding respective turns decreases as the distance between said respective turns and said feed point increases.

4. The antenna of claim 1, wherein said antenna comprises a first and second resonating frequency and operates in a first and second operating frequency band of a cellular radio system, said first resonating frequency being substantially similar to said first operating frequency band; and said second resonating frequency being substantially similar to said second operating frequency band.

5. The antenna of claim 1, further including a coupling part having a cylindrical hollow for receiving said first end of said cylindrical coil conductor of said antenna.

6. The antenna of claim 5, wherein said first end of said cylindrical coil conductor of said antenna includes a support thread for coupling to said cylindrical hollow of said coupling part.

* * * * *